US008419044B2

(12) United States Patent
Würthner

(10) Patent No.: US 8,419,044 B2
(45) Date of Patent: Apr. 16, 2013

(54) WINTER SPORTS GEAR COMPRISING RUNNERS

(75) Inventor: Holger Würthner, Villingen-Schwenningen (DE)

(73) Assignee: Onyx-Systems Patentmanagement GmbH, Villingen-Schwenningen (DE)

( * ) Notice: Subject to any disclaimer, the term of this patent is extended or adjusted under 35 U.S.C. 154(b) by 484 days.

(21) Appl. No.: 12/449,545

(22) PCT Filed: Feb. 18, 2008

(86) PCT No.: PCT/EP2008/001230

§ 371 (c)(1), (2), (4) Date: Sep. 18, 2009

(87) PCT Pub. No.: WO2008/098795

PCT Pub. Date: Aug. 21, 2008

(65) Prior Publication Data

US 2010/0096839 A1 Apr. 22, 2010

(30) Foreign Application Priority Data

Feb. 16, 2007 (DE) ..... 10 2007 008 365

(51) Int. Cl.
*A63C 5/04* (2006.01)
*A63C 1/32* (2006.01)

(52) U.S. Cl.
USPC ..... 280/609; 280/11.18

(58) Field of Classification Search ..... 280/14.21, 280/15, 18, 28.14, 28.16, 87.042, 604, 607, 280/608, 609, 11.12, 11.18; 411/68, 74
See application file for complete search history.

(56) References Cited

U.S. PATENT DOCUMENTS

| | | | | | |
|---|---|---|---|---|---|
| 2,038,077 | A * | 4/1936 | Haglund | 280/601 |
| 2,142,459 | A * | 1/1939 | Saby | 280/604 |
| 3,074,733 | A * | 1/1963 | Norgiel | 280/11.18 |
| 3,202,437 | A * | 8/1965 | Masbruch | 280/18 |
| 3,378,274 | A * | 4/1968 | Poppen | 280/18 |
| 3,428,979 | A * | 2/1969 | Johnson | 441/68 |
| 3,774,254 | A * | 11/1973 | Meyer | 441/68 |
| 4,175,766 | A * | 11/1979 | Barwin | 280/608 |
| 4,673,196 | A * | 6/1987 | Hall | 280/825 |
| 5,158,318 | A * | 10/1992 | Dittmar | 280/608 |
| 5,344,177 | A * | 9/1994 | Rouser et al. | 280/610 |
| 5,570,893 | A * | 11/1996 | Swande | 280/11.18 |
| 6,276,699 | B1 * | 8/2001 | Simmons et al. | 280/28 |
| 7,510,206 | B2 * | 3/2009 | Walker | 280/600 |
| 2002/0105166 | A1 * | 8/2002 | Lemieux | 280/609 |
| 2006/0097484 | A1 * | 5/2006 | Walker | 280/600 |
| 2006/0251486 | A1 * | 11/2006 | Schamesberger | 409/159 |
| 2009/0273149 | A1 * | 11/2009 | Wilson et al. | 280/11.18 |

FOREIGN PATENT DOCUMENTS

| | | |
|---|---|---|
| DE | 737 406 A | 7/1943 |
| DE | 690 10 355 T2 | 9/1995 |

* cited by examiner

*Primary Examiner* — J. Allen Shriver, II
*Assistant Examiner* — Bridget Avery
(74) *Attorney, Agent, or Firm* — Nath, Goldberg & Meyer; Jerald L. Meyer; Scott C. Langford

(57) ABSTRACT

Winter sports gear, particularly an ice skate, include runners to which a sliding blade (3) is detachably connected. The sliding surface (1) of the sliding blade (3) is provided with at least one, in this case three, profiled grooves (4) that extend in the direction of travel. Bulge-type dams (5) extend on both sides of the profiled grooves (4).

5 Claims, 2 Drawing Sheets

WINTER SPORTS GEAR COMPRISING RUNNERS

Figure 1:
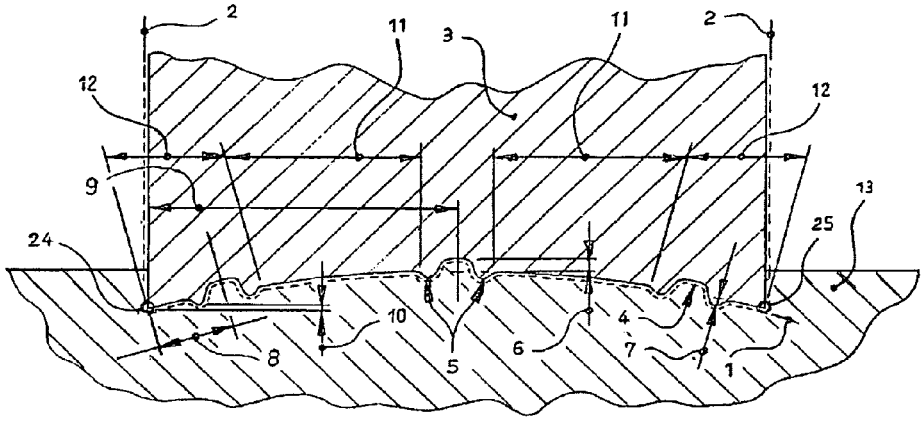

This is a National Phase Application filed under 35 USC 371 of International Application No. PCT/EP2008/001230, filed on Feb. 18, 2008, which claims foreign priority benefit under 35 USC 119 of German Application No. 10 2007 008 365.5, filed on Feb. 16, 2007, the entire content of each of which is hereby incorporated herein by reference in its entirety.

The invention concerns winter sports gear comprising runners, which have sliding surfaces resting on the ice or snow surface.

Such winter sports gear, e.g., skates, have no means of impeding the sliding or water film on the concave running surface of the runners. The extremely thin sliding or water film arising under the pressure and friction as a runner-type gear advances is forced out to the side from the sliding surface, depending on the dynamic conditions. Thus, the sliding or water film which is absolutely essential for perfect sliding cannot be maintained constant under all dynamic conditions. The breaking away of the sliding or water film, especially when moving along a curve, substantially increases the frictional drag between the sliding surface of the runner and the ice or snow on which the sliding occurs. Thanks to the concave shape of the running surface of the aforementioned skate runners, in the most favorable case the sliding or water film can only be maintained over the entire width of the sliding surface as long as the runner equipment is in an absolutely vertical position during its movement. But since it is nearly impossible to maintain this ideal vertical position of the runner device during normal motion, a large part of the sliding or water film is forced out from the sliding zone of the runner device in rapid succession, so that the sliding ability of the runner device is substantially reduced. When using highly polished sliding surfaces, the sliding or water film is pressed out to the side even more intensely, since the sliding or water film can flow unhindered across the outer edges. At the same time, runner devices with highly polished sliding surfaces lose a large portion of their linear guidance properties, since they are only stabilized by the two outer edges subject to intense wear. The stabilization of the sliding or water film on uneven ice or snow surface, especially when moving along a curve, is extremely difficult, since the repeatedly interrupted sliding or water film can also appear alternately on either side of the sliding surface at irregular intervals. One of the greatest drawbacks occurs, however, when the runner device is deflected sideways, since the flat or concave sliding surfaces of the runner device alternately press the initially built-up sliding or water film like a snow plow outward at the side where the edge of the running surface has lifted off from the ground. Furthermore, the outer edge of the runner alternately lifts off from the ground during acceleration of the runner device, such as a skate, thus favoring the flowing away of the sliding or water film. The result is that the sliding or water film is substantially minimized and thus the friction increases significantly between the ground and the runner device during the acceleration phase.

Somewhat of a stabilization of the water film and an improvement in the sliding effects can be achieved in that the sliding surface of the winter sports gear is provided in familiar fashion with at least one profiled groove extending in the direction of movement.

Thus, from DE 690 10 355 T2 there is known a winter sports gear of this kind, namely, a snow shoe ring, with a sole having such an axial channel, which can be detached from the shoe by a wedge.

Moreover, from DE 737 406 A there is known a ski in whose sliding surface a rail is used, having grooves extending in the direction of movement.

But these profiled grooves are still not enough to maintain the sliding or water film between the ground and the sliding surface of the runner in every dynamic situation.

Thus, the present invention proposes to create a winter sports gear in which the sliding surface of the runners is configured so that the sliding or water film is better stabilized, which should decisively improve the sliding ability of the runners.

This problem is solved in a winter sports gear of the indicated kind in that bulgelike dams are provided on either side at the edges of the profiled groove, extending parallel with it. These dams prevent too quick a flow-off or detachment of the sliding or water film. This enhances the sliding ability, as well as the linear stabilization of the runner device, which leads to an improvement in the dynamic properties under all conditions of ice or snow, faster speed on curves and rate of acceleration, and better braking.

Due to the extremely fine and exact profiling of the sliding surfaces, an aftermachining of the worn-down profiling of the sliding surface, such as one generated by laser equipment, is not possible on account of machining and cost factors.

For this reason, it is proposed to provide the sliding surfaces with the profiled groove and the dams on either side at sliding blades or sliding edges which can be detachably connected to the runners, so that a simple and cost-effective replacement is possible.

The described measures for winter sports runner-type gear lead to the following lested advantages:

According to one configuration, three profiled grooves are provided, namely, one in the middle and another one near each of the edges of the sliding surface, all grooves having bulgelike dams on either side, which bound central sliding zones and outer sliding zones extending in the direction of movement.

Advantageously, the profiled grooves may be deeper than the mentioned sliding zones.

The profiled grooves can have different cross sectional shapes. Examples include a trapezoidal profile, and the profiled grooves are broader than the neighboring bulgelike dams.

Form-grinding, form-rolling, form-molding or form-sintering are suitable for the fabrication of the profiled sliding surfaces.

The sliding surfaces can also consist of metal, the profiled grooves being made by laser profiling with simultaneous forming of the bulgelike dams. The bulgelike dams may be constructed with a height of around 0.02 mm. A winter sports gear in the sense of the disclosure can be a skate according, with the profiled sliding surface provided at its interchangeable sliding blade. This sliding blade can be concave.

The disclosed technology is suitable both for skis and for snowboards, whose snow runner or whose side edges are provided with angled sliding rails, whose horizontal and vertical sliding surfaces have profiled grooves with the bulgelike dams. The horizontal and vertical sliding surfaces may have at least one profiled groove with bulgelike dams.

To enable a quick and easy replacement of the sliding surfaces, the interchangeable profiled edges can be mounted and may be connected detachably to the snow runner by a clip lock.

For high stress, the sliding surfaces may be coated with hard material.

The object of the invention is explained in detail hereafter by means of preferred sample embodiments, which are shown in the drawings.

Figure 2:
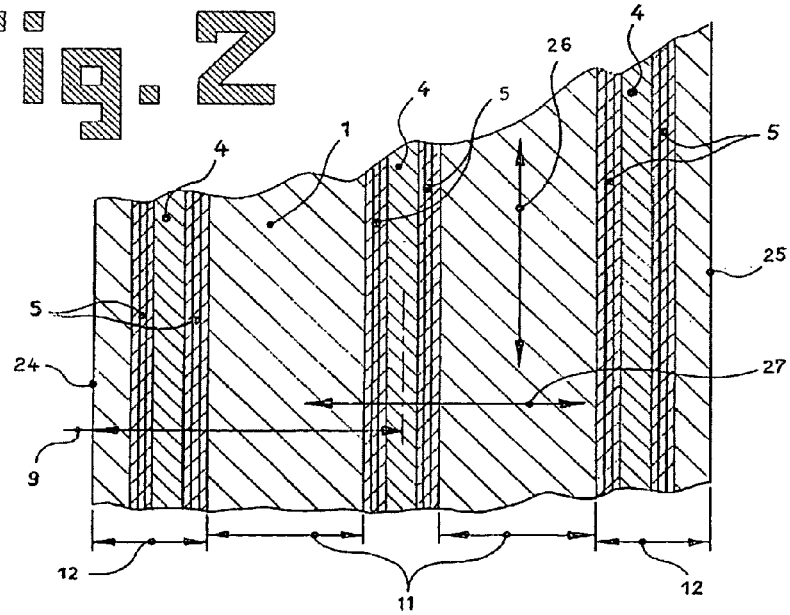
Figure 3:
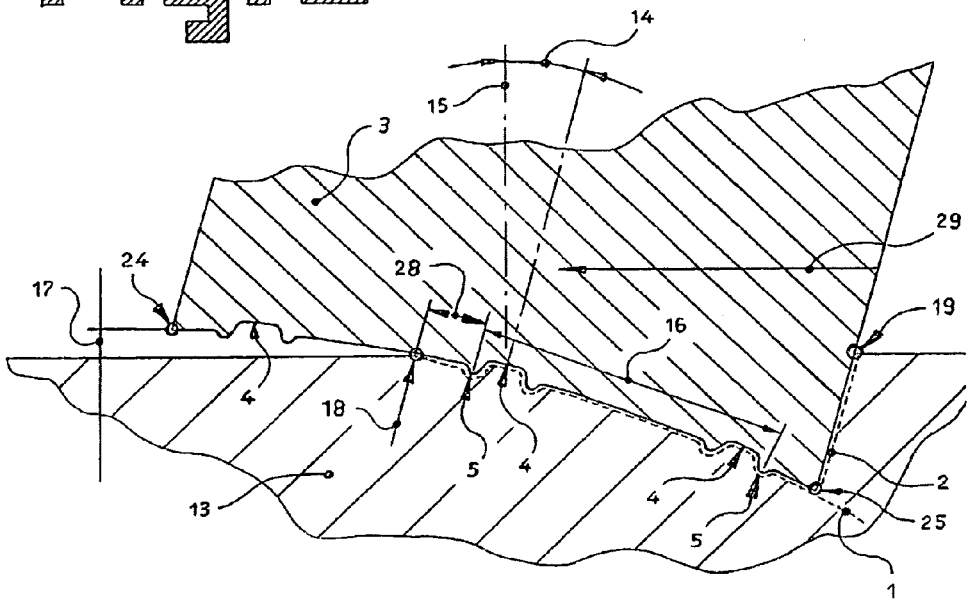
Figure 4:
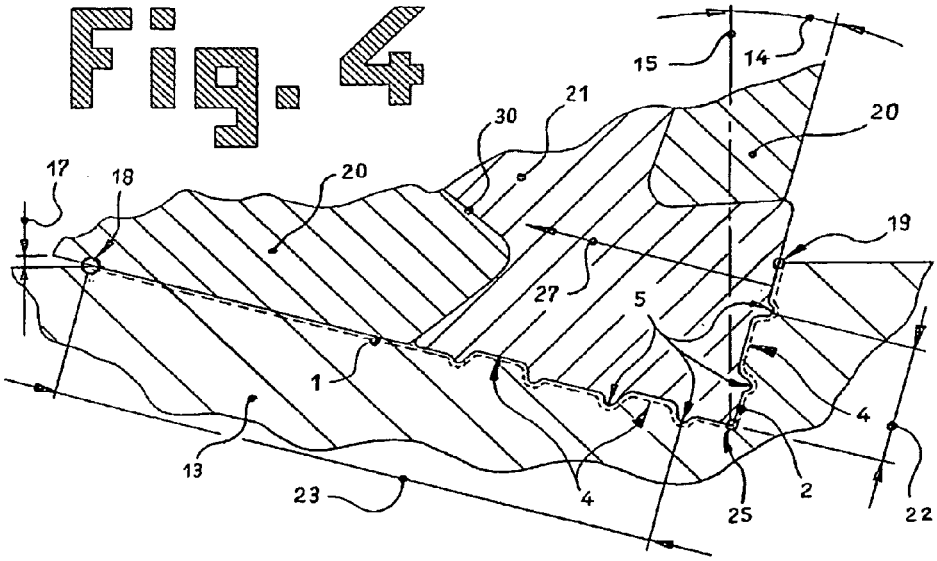

The drawings show:

FIG. 1, partial cross section of a skate runner placed on the ice surface,

FIG. 2, partial top view of the skate runner of FIG. 1,

FIG. 3, partial cross section per FIG. 1 of the interchangeable blade of the skate runner in slanted position, and FIG. 4, partial cross section of the interchangeable profiled edge of a ski or snowboard with clip lock in slanted position.

FIGS. 1-3 show a first sample embodiment of an interchangeable blade 3 of an ice runner being placed upon a slippery ground, here, an ice surface 13. The ice runner's interchangeable blade 3 has vertical sliding surfaces 2 and essentially horizontally extending sliding surfaces 1. Profiled grooves 4 are worked into the horizontal sliding surfaces 1 and are bounded by profiled dams 5 on either side.

The mode of operation of the profiled groove runner system is explained hereafter by means of this skate ice runner.

When the ice runner's interchangeable blade 3 is placed on the ice surface 13, a sliding or water film is built up between horizontal sliding surface 1 and the slippery ground 13, starting with the pressing of the ice runner's interchangeable blade 3 into the slippery ground 13. An optimal sliding ability of the ice runner" interchangeable blade occurs only thanks to the formation of a continuous sliding or water film between the A edge 24 and the B edge 25. To satisfy this condition, the ice runner's interchangeable blade 3 must be forced so deep into the slippery ground 13 that the slippery ground 13 fills up the profile depth 6 of all profiled grooves 4. In order to stabilize the resulting sliding or water film, only around 0.0013 mm thick, on the horizontal sliding surface 1 under all dynamic movements of the ice runner's interchangeable blade 3, the horizontal sliding surface 1 is divided into the two central sliding zones 11 and the two outer sliding zones 12. The division of the respective sliding zones on the horizontal sliding surface is done by means of the profiled grooves 4.

Starting from the profiled groove 4 in the central profile position 9, the sliding or water film is stabilized in the two central sliding zones 11. The stabilization of the sliding or water film in the two sliding zones 11 occurs by means of the profiled dams 5, which are situated at the edges of the profiled grooves 4 and extend as bulges out from the horizontal sliding surface 1. The shape of the horizontal sliding surface 1 with the profiled grooves 4 and its bulgelike dams 5 on either side can be made by form grinding, rolling, injection molding, or sintering. Preferably, the profiled grooves 4 with the profiled dams 5 can be introduced into the horizontal sliding surface 1 in cost effective manner by laser technology. In laser profiling of the ice runner's interchangeable blade 3, the laser beam produces at least one linear profiled groove 4 of desired width and depth by melting the horizontal sliding surface 1, preferably consisting of metal. The molten metal forms a bulgelike profiled dam 5 at the edges of the profiled groove. The possible height 7 of the profiled dam and the volume of the profiled dam 5 depends on the melt volume of the profiled groove 4. The texture of the slippery ground 13 and the dynamic requirements for movement of the runner device will determine the melt volume of the profiled groove 4. Since the maximum achievable sliding or water film for winter sports runner devices is only around 0.0013 mm thick, a profiled dam height 7 of around 0.02 mm is quite sufficient to guarantee a perfect sliding or water film stabilization on the horizontal sliding surface 1. In order to achieve a good braking behavior of the ice runner's interchangeable blade 3, the profile side spacing 8 must be large enough for a distinct differential height 10 to exist between the A edge 24 and the profiled dam height 7. The same also holds for the B edge 25. The described design of the ice runner's interchangeable blade 3 prevents the flowing away of the sliding or water film from the horizontal sliding surface 1 thanks to the two outer profiled grooves 4 when subjected to vertical loading.

The top view in FIG. 2 shows the arrangement of the central linear profiled groove and the two linear outer profiled grooves with their bordering dams on either side in the sliding surface of the ice runner.

In this sample embodiment, the horizontal sliding surface 1 of the ice runner's interchangeable blade has three linear profiled grooves 4, wherein the profiled groove 4 situated at the central profile position 9 divides the horizontal sliding surface 1 into the two central sliding zones 11 and the two outer sliding zones 12. The linear profiled grooves 4 extending in the lengthwise direction of movement 26 of the ice runner's exchangeable blade 3 have the profiled dams 5 at the edges. The profile grooves 4, preferably melted out by means of a laser beam, stabilize with the help of the profiled dams 5 the sliding or water film created on the slippery ground 13 by pressure and friction of the ice runner's interchangeable blade 3. The two outer profiled grooves 4 with their profiled dams 5 prevent a sideways flowing away of the sliding or water film across the A edge 24 and the B edge 25.

Thanks to the concentration of the sliding or water film on the horizontal sliding surface 1 between the two outer profiled dams 5, a continuous optimal sliding or water film of around 0.0013 mm thickness is formed within the two outer profiled grooves 4. At the same time, a perfect linear stability in the lengthwise direction of movement 26 of the runner device is achieved by means of the profiled grooves 4, since the profiled grooves 4 by their respective profiled dams 5 prevent a shifting of the horizontal sliding surface 1 in the transverse direction of movement 27 on the slippery ground 13.

The drawing in FIG. 3 shows the ice runner's interchangeable blade 3 per FIGS. 1 and 2 in an angular position which occurs when moving along a curve, when accelerating or when braking. Thanks to the steady change in the runner angle 14 relative to the vertical axis 15 that occurs here under the motion dynamics, the horizontal sliding surface 1 is pressed into the slippery ground 13 on one side. The B edge 25 penetrates deep into the slippery ground 13 and necessarily lifts the A edge off the slippery ground 13 by the changing opening 17 of the sliding surface. Depending on the size of the runner angle 14, the sliding surface opening 17 will open or close and create a larger or smaller horizontal sliding surface 1. In corresponding manner, the same process takes place due to the change in the runner angle 14 in the opposite direction, since in this case the A edge 24 penetrates into the slippery ground 13 and the B edge 25 is lifted off from the slippery ground. Due to this alternatingly produced sliding surface opening 17, a substantial portion of the horizontal sliding surface 1 is lost, depending on the size of the sliding surface opening 17, which more or less worsens the sliding properties of the ice runner's interchangeable blade 3. In order to maintain a sufficient sliding or water film within the contact sliding zone 16 for a sliding surface opening 17, the profiled grooves 4 are situated at each end of the contact sliding zone 16, and the profiled dams 5 at their edges prevent a flowing away of the sliding or water film. Depending on the size of the runner angle 14, a more or less large sliding film loss zone 28 is formed, from which the sliding or water film of the sliding film loss zone 28 emerges from the sliding film horizontal exit 18. The sliding or water film produced between the vertical sliding surface 2 and the slippery ground 13 is expelled at the sliding film vertical exit 19. In addition to the stabilization of the sliding or water film by means of the linear profiled grooves 4 with the profiled dams 5 extending in the direction of movement, a linear guidance of the ice runner's interchangeable blade 3 is also achieved for a more or less large runner angle 14 and the resulting loss of guidance by the A edge 24 or the B edge 25, since in addition to the A edge 24 or the B edge 25 at least one profiled groove 4 is located in the slippery ground 13, providing the ice runner's interchangeable blade 3 with a perfect linear guidance in the slippery ground 13. Especially when moving along a curve the profiled grooves 4 improve the exact tracking of the ice runner's interchangeable blade 3. When the ice runner sports gear accelerates, thanks to the extreme increase in the runner angle 14 the ice runner's interchangeable blade 3 with the B edge 25 is forced deep into the slippery ground 13. In order to compensate for the transverse force resulting in direction 29 when the runner gear accelerates, at least one linear profiled groove 4 is situated in the slippery ground 13 in addition to the B edge 25. Thanks to the profiled grooves 4 and their profiled dams 5, as well as the B edge 25, extremely large transverse forces acting in direction 29 along with high axial forces can be transmitted to the ice runner's interchangeable blade 3 without the ice runner's interchangeable blade 3 losing its hold in the slippery ground 13 from the action of the transverse force 29. The explained mode of operation also occurs in similar fashion, of course, when the A edge dips into the slippery ground 13.

The runner angle 14 at the same time produces the braking angle of the ice runner's interchangeable blade 3. A relatively small runner angle 14 during braking is sufficient to achieve a quick braking deceleration. Since, during the braking process, at least one profiled groove 4 and its profiled dams 5 are still located in the slippery ground 13, in addition to the B edge 25, the transverse shifting of the linear profiled groove 4 extending in the direction of movement along with the B edge 25 produces a great sliding drag, resulting in a short braking distance.

FIG. 4 shows the design and the function of an interchangeable profiled edge with clip locking for a ski or a snowboard. The mechanical construction and the function with the features stabilizing the sliding or water film correspond to the features realized in the sample embodiment per FIGS. 1, 2, and 3. Departing from them, the horizontal sliding surface 1 in this sample embodiment is designed as a flat sliding surface.

Interchangeable profiled edges 21 are detachably inserted into the snow runner 20 at either side by means of a clip locking system 30. Of course, the fastening of the interchangeable profiled edges 21 can occur in a different manner.

As shown in FIG. 4, at least one profiled groove 4 with its profiled dams 5 on either side, extending in the direction of movement of the snow runner 20, is situated in the horizontal sliding surface 1. Due to the absolute flatness of the horizontal sliding surface 1, an optimal sliding or water film can be stabilized on the horizontal sliding surface 1 between the snow runner 20 and the slippery ground 13, i.e., the snow surface, by only at least one but preferably two profiled grooves and their profiled dams 5 projecting from the horizontal sliding surface 1. The interchangeable profiled edge 21 is arranged so that the horizontal as well as the vertical profiled groove 4 and their profiled dams 5 are located in immediate proximity to the B edge 25. If the snow runner 20 is lying flat on the slippery ground 13, i.e., the snow surface, for example, the angle of the vertical axis 15 is 90 degrees. In this position, the sliding or water film extends almost from one other edge of the snow edge to the other. But in operation, the runner angle 14 will increase or decrease in rapid sequence, due to the dynamic movements of the snow runner 20 caused by the user and the slippery ground, so that the size of the sliding film horizontal zone 23 is directly affected. A premature emergence of the sliding or water film at the sliding film horizontal exit 18 is prevented by the arrangement of several profiled grooves 4 and their profiled dams 5 on the horizontal sliding surface 1, as long as the sliding surface opening 17 does not become too large.

The distinctly improved sliding properties of the snow runner 20 are supplemented by an outstanding stability on curves, especially when the slippery ground 13 is iced over. Since, as the runner angle 14 increases, the B edge 25 penetrates deep into the icy and slippery ground 13, the vertical sliding surface 2 is pressed sideways into the iced-over slippery ground 13, whereupon the linear profiled groove 4 extending in the direction of movement of the snow runner 20 and situated in the vertical sliding surface 2, along with the B edge 25 and the linear profiled groove 4 in the horizontal sliding surface 1, ensure a precise tracking as well as above-average holding of the snow runner 20 in the iced-over slippery ground 13. At the same time, thanks to the bulgelike profiled dams 5 situated at the edges of the profiled groove 4 a flowing away of the sliding or water film from the sliding film vertical zone is prevented, so that only a minimal loss of sliding or water film occurs at the sliding film vertical exit 19. As described in conjunction with FIG. 2, the linear profiled grooves 4 and their profiled dams 5 minimize the shifting of the snow runner 20 in the iced-over slippery ground 13 in the transverse direction of movement 27 and ensure an improved tracking of the snow runner 20 in the slippery ground 13.

The measures proposed by the invention for winter sports runner-type gear lead to the following listed advantages:

- Improved sliding or water film stabilization on the horizontal and vertical sliding surface of the runner with profiled grooves and profiled dams.
- Improved sliding properties due to stabilization of the sliding or water film, especially in the zones of the runner under high compressive load.
- Economical profiling of the interchangeable sliding blade and interchangeable profiled edges/bands, preferably by means of laser technology.
- No resharpening of the ski or snowboard edges when one uses interchangeable profiled edges with clip locking.
- Improved tracking of the runner gear thanks to the profiled grooves and dams.
- Improved holding on curves, especially when the slippery ground is iced over, thanks to multiple edges engaging with the ice.
- No total detachment of the sliding or water film when moving along a curve, which minimizes the speed loss.
- High acceleration of the skate runner.
- Improved braking properties of the skate runner due to multiple edges engaging with the ice thanks to the profiled grooves and profiled dams.
- The vertical profiling of the ski or snowboard edges prevents the total loss of the sliding or water film especially on a curve and at the same time improves the curve holding on an iced-over slippery ground.
- Lowering of operating costs, especially when used for skis or snowboards, thanks to the use of interchangeable profiled edges.
- Longer service life for the edges when using a hard TIN coating on the interchangeable profiled edges of around 2300 HV.

LIST OF REFERENCE NUMBERS

1 horizontal sliding surface
2 vertical sliding surface

3 ice runner's interchangeable blade
4 profiled groove
5 profiled dam
6 profile depth
7 profiled dam height
8 profile side spacing
9 central profile position
10 differential height
11 central sliding zone
12 outer sliding zone
13 slippery ground
14 runner angle
15 vertical axis
16 contact sliding zone
17 sliding surface opening
18 horizontal exit of sliding film
19 vertical exit of sliding film
20 snow runner
21 interchangeable profile edge
22 sliding film vertical zone
23 sliding film horizontal zone
24 A edge
25 B edge
26 lengthwise direction of movement
27 transverse direction of movement
28 sliding film loss zone
29 transverse force
30 clip lock system

The invention claimed is:

1. An ice skate, comprising:

a sliding surface for sliding along an ice surface, the sliding surface comprising a concave surface with middle and sliding edges;

the sliding surface further comprising profiled grooves, whereby at least one profiled groove is provided in the middle, forming central sliding zones, and other profiled grooves near each of the sliding edges form outer sliding zones; and the profiled grooves comprising transverse force transmitting bulge-like dams having rounded-off diameters protruding from the sliding surface on either side of the profiled grooves, and the profiled grooves and the bulge-like dams extending in a direction of movement, such that the central sliding zone and the outer sliding zones are configured to prevent loss of a water film created between the sliding surface and the ice surface and to maintain a constant water film under different dynamic loads, wherein the profiled grooves are deeper than the sliding zones and the outer sliding zones, and wherein the sliding surface further comprises an interchangeable sliding blade.

2. The ice skate according to claim 1, wherein the sliding surfaces with the profiled grooves and the bulge-like dams are made by form-grinding, form-rolling, form-molding or form-sintering.

3. The ice skate according to claim 1, wherein the sliding surfaces consist of metal and the profiled grooves are made by laser profiling with simultaneous forming of the bulge-like dams.

4. The ice skate according to claim 1, wherein the bulge-like dams have a height of around 0.02 mm.

5. The ice skate according to claim 1, wherein the sliding surfaces are coated with hard material.

* * * * *